United States Patent [19]

Eshelman

[11] 3,964,456

[45] June 22, 1976

[54] IGNITION DISTRIBUTOR

[75] Inventor: Philip V. Eshelman, Southfield, Mich.

[73] Assignee: Colt Industries Operating Corporation, New York, N.Y.

[22] Filed: Dec. 24, 1974

[21] Appl. No.: 536,194

[52] U.S. Cl. ..... 123/117 R; 64/25; 200/31 CA

[51] Int. Cl.[2] ..... F02D 5/04

[58] Field of Search ..... 123/117 R, 146.5 A; 200/31 CA; 64/25

[56] References Cited

UNITED STATES PATENTS

| | | | |
|---|---|---|---|
| 2,388,994 | 11/1945 | Phelon | 64/25 |
| 2,391,525 | 12/1945 | Spengler | 123/117 R |
| 2,393,344 | 1/1946 | Scott | 64/25 |
| 2,549,750 | 4/1951 | Spengler | 64/25 |
| 2,677,946 | 5/1954 | Purdy | 64/25 |
| 3,045,458 | 7/1962 | Cambell et al. | 123/117 R |
| 3,320,770 | 5/1967 | Beuacqua | 123/117 R |
| 3,482,559 | 12/1969 | Salomon | 123/117 R |
| 3,715,528 | 2/1973 | Habert | 64/25 |
| 3,828,579 | 8/1974 | Groom | 64/25 |

FOREIGN PATENTS OR APPLICATIONS

| | | | |
|---|---|---|---|
| 798,059 | 7/1958 | United Kingdom | 200/31 CA |

*Primary Examiner*—Charles J. Myhre
*Assistant Examiner*—Paul Devinsky

[57] ABSTRACT

An ignition distributor for an internal combustion engine has a drive shaft adapted to be driven in accordance with engine speed, a pulse generating rotor coaxial with said shaft and adapted to be angularly adjustable relative thereto, and a single flyweight adapted for rotation in accordance with the speed of rotation of said drive shaft and operatively connected to said rotor for angularly adjusting said rotor generally in accordance with the speed of rotation of said drive shaft.

14 Claims, 26 Drawing Figures

IGNITION DISTRIBUTOR

BACKGROUND OF THE INVENTION

Generally, as is known in the prior art, in the field of centrifugal weight advance mechanisms for ignition distributor assemblies, the centrifugal weights are held in place at relatively low engine speeds by the action or resistance of a primary spring acting through a moment arm. When engine speed is increased the centrifugal force moves the centrifugal weights generally radially outwardly from the center of rotation. Such outward movement of the centrifugal weights caused an extension, or additional loading, of the primary spring while at the same time increasing the effective length of the associated moment arm against which the spring reacted. The overall geometry of the coacting elements and the spring was such as to result in a linear relationship as between the degrees of spark or ignition advance and the speed of rotation of the distributor drive shaft. Further, it has been known that by changing the said geometry the relationship between the degrees of ignition advance and speed of rotation of the distributor drive shaft (engine speed) can be changed from a purely linear relationship.

As has already been indicated, in such prior art distributors two weights were used. One of such weights was attached to the primary spring while the other of such weights was attached to a secondary spring. The two weights were, in turn, operatively connected to each other through a suitable mechanical linkage. Such arrangements almost invariably created large internal forces in the overall mechanism resulting in mechanical hysteresis which is a serious and undesirable characteristic in any ignition distributor.

Accordingly, the invention as herein disclosed and described is primarily directed to the solution of the above and other attendant problems.

SUMMARY OF THE INVENTION

According to the invention, an ignition distributor for an internal combustion engine comprises a drive shaft adapted to be driven in accordance with engine speed, a rotatable member operatively carried by the drive shaft and effective to cause a making and breaking of an associated electrical circuit, said rotatable member being generally coaxial with said shaft and adapted to be angularly adjustable relative thereto, means responsive to changes of engine operating conditions for angularly adjusting said rotatable member relative to said shaft, said means responsive to changes of engine operating conditions comprising a single centrifugal flyweight operatively carried by said shaft and operatively connected to said rotatable member, said flyweight being effective to move radially outwardly from the axis of rotation of said shaft in response to rotation of said shaft and to thereby cause said angular adjustment of said rotatable member relative to said shaft, and at least first and second spring means operatively connected to said single flyweight for resiliently resisting said radially outward movement of said flyweight.

Various general and specific objects and advantages of the invention will become apparent when reference is made to the detailed description of the invention considered in conjunction with the accompanying drawings.

BRIEF DESCRIPTION OF THE DRAWINGS

In the drawings, wherein for purposes of clarity certain details and/or elements may be omitted for purposes of clarity.

DETAILED DESCRIPTION OF THE PREFERRED EMBODIMENTS

Figure 1:
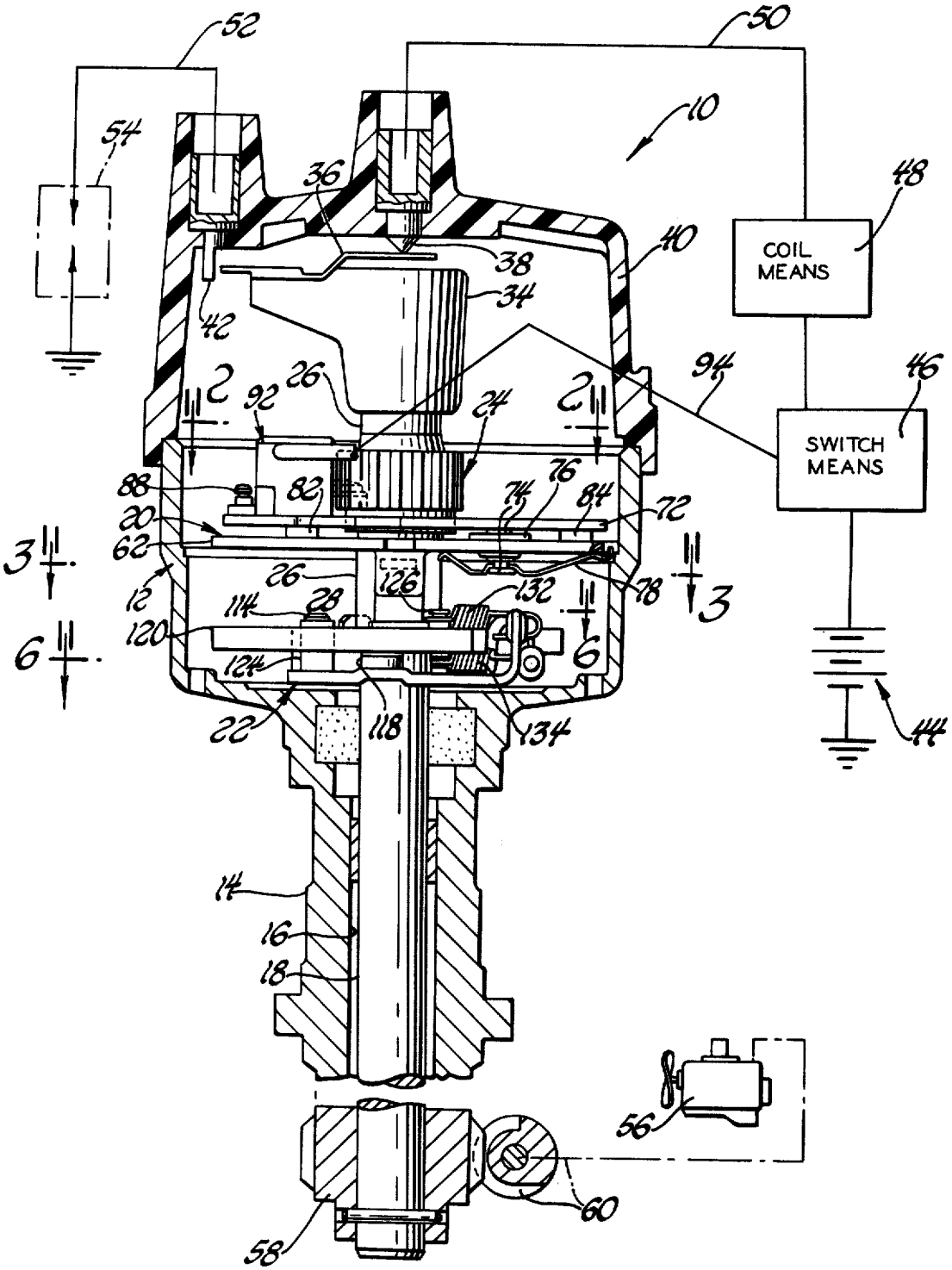
FIG. 1 is an elevational view of an ignition distributor constructed in accordance with the invention with portions of the distributor housing being cut away and in cross section, along with a schematic illustration of the associated engine.

Referring now in greater detail to the drawings, FIG. 1 illustrates an ignition distributor 10 as comprising a housing 12 including a depending reduced portion 14 having an opening 16 therethrough for the reception of a driving shaft 18. The upper end of the cup-shaped housing 12 carries a plate assembly 20 while, generally therebelow, a distributor shaft plate assembly 22 is fixedly secured to and carried by shaft 18 for rotation therewith.

An ignition switching or breaker rotor 24 is secured to and carried by a generally tubular shaft extension 26 which also carries generally radially or laterally extending oppositely directed arms 28 and 30. Extension 26 is generally slidably received about upper end 32 of shaft 18 as to be angularly rotatable with respect thereto.

An insulated distributor rotor 34, having a springlike electrical contact 36 thereon, is secured to the upper portion of tubular shaft 26 and is adapted to be rotated thereby normally in accordance with engine speed. Contact 36, which is continually biased against the ignition coil input terminal 38 of the distributor cap 40, is adapted to sequentially traverse the output terminals 42 (of which only one is shown) of cap 40 and is so positioned that the two are in juxtaposition whenever the electrical discharge therebetween occurs.

Generally schematically and diagrammatically, FIG. 1 also illustrates a related suitable source of electrical potential 44 electrically connected in series with related switching means 46 and ignition coil means 48. Suitable electrical conductor means 50 interconnects coil means 48 to the coil input terminal 38 while, typically illustrated, an electrical conductor 52 electrically interconnects a respective output terminal 42 to a corresponding spark plug assembly 54.

Distributor drive shaft 18 is, of course, rotated in timed relation with the associated engine 56 by means of a gear member 58 cooperating with some suitable output transmission 60 of the engine 56.

Figure 2:
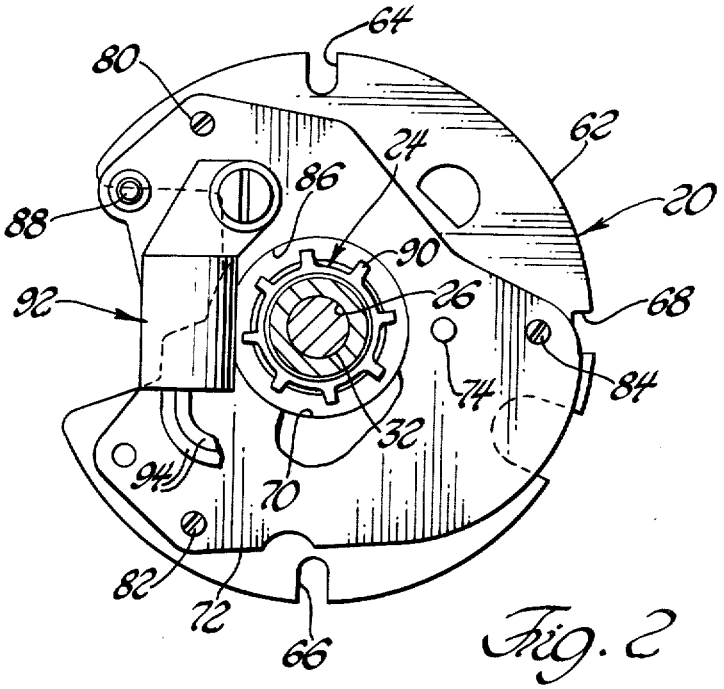
FIG. 2 is a view taken generally on the plane of line 2—2 of FIG. 1, with the distributor housing being eliminated, and looking in the direction of the arrows.

Referring to both FIGS. 1 and 2, the breaker plate assembly is illustrated as comprising a lower generally circular breaker plate 62 securely attached to the housing 12 as by screws (not shown) passing through clearance slots 64, 66 while the relative angular position may be determined as by a notch 68 in plate 62 and cooperating lug or locator internally of housing 12. An aperture 70 in plate 62 permits the passage therethrough of the switching rotor 24. An upper, relatively movable, breaker plate 72 is secured as to a pivot post 74 which extends downwardly through a pivot bushing or bearing 76 carried by the lower breaker plate 62.

As best seen in FIG. 1, the lower end of pivot post 74 depends downwardly below bushing 76 where such lower end is engagedly received with a notch formed generally medially in a spring 78 having opposed arms operatively engaging the lower breaker plate 62. Spring 78 thusly serves to prevent pivot post 74 from being unintentionally withdrawn from bearing 76 and, at the same time, provide a relatively slight downward force on both the pivot post 74 and upper breaker plate 72. Such downward force maintains the spaced slidable foot or pad members 80, 82 and 84, carried by upper breaker plate 72, in sliding contact with the upper surface of lower breaker plate 62.

Similarly to lower breaker plate 62, upper plate 72 is also provided with an aperture 86 for the free passage therethrough of switching or breaker rotor 24. A pivot-like connecting post 88 is secured to upper breaker plate for enabling connection thereto of a related pressure responsive motor means such as a diaphragm responsive to, for example, engine manifold vacuum upon part throttle opening to thereby rotate said upper breaker plate about the axis of pivot 74 to achieve desired part-throttle ignition advance. Since such vacuum motors for ignition distributors are well known in the art and for purposes of clarity of illustration such vacuum motor means is not illustrated; however, a typical vacuum motor assembly for an ignition distributor is illustrated at 24 of U.S. Pat. No. 3,098,366 and clearly described therein.

In the embodiment disclosed, the switching rotor 24 is a wheel-like member having eight angularly equally spaced lobes 90 which, as they respectively pass by and in close proximity to a related sensor or pick-up assembly 92, fixedly carried by and on the upper breaker plate 72, cause the sensor 92 to, in timed relationship, produce an electrical pulse signal and apply it via conductor means 94 to switch means 46. The intermittent opening of switching means 46 enables corresponding electrical charging of coil means 48 while the sequential juxtaposed alignment of distributor rotor contact 36 with output terminals 42 enables the electrical discharging of charged coil means 48.

The distributor shaft plate assembly is illustrated as comprised of a generally transverse plate 96 including a sleeve portion 98, which may be, for example, brazed to plate 96. The plate 96 and sleeve 98 are then suitably secured to drive shaft 18, as by, for example, a press or interference fit, in order to rotate only in unison with shaft 18. Plate 96 has a generally offset support portion 100 with combined fastening and locating arms 102 and 104 formed integrally with plate 96 as to be directed upwardly and respectively receivable within apertures 106 and 108 formed in a counterbalance weight 110. As best shown in, for example, FIGS. 3 and 5, counterweight 110 is situated atop offset support 100 and retained thereon by said retainer-locator arms 102 and 104.

Plate 96 has an aperture 112 into which the lower end of a pivot post 114 is fixedly received as to enable the upward extension thereof. An additional aperture 116, in plate 96, fixedly receives therein the lower end of a stabilizer or support member 118.

A flyweight 120 has an aperture 122 formed therethrough in which a tubular bearing 124 is fixedly secured as by, for example, brazing. As shown in, for example, FIGS. 1, 3 and 4, the flyweight is assembled onto the plate assembly 22 by having the tubular bearing 124 received about pivot post 114.

A spring post 126 extending through and carried by flyweight 120 has upper and lower disposed annular grooves for the respective engagement of ends 128 and 130 of secondary and primary springs 132 and 134.

Figure 9:
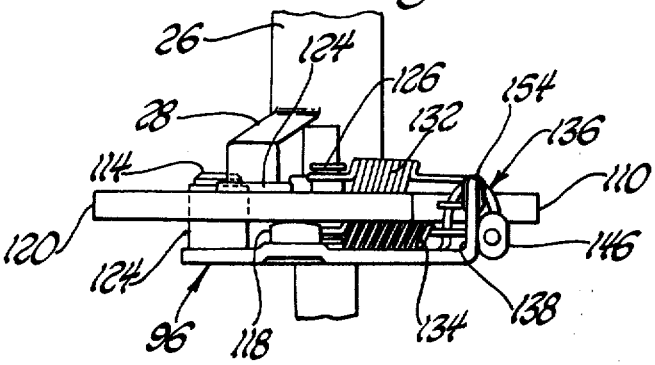
FIG. 9 is a view taken generally on the plane of line 9—9 of FIG. 7 and looking in the direction of the arrows.
Figure 10:
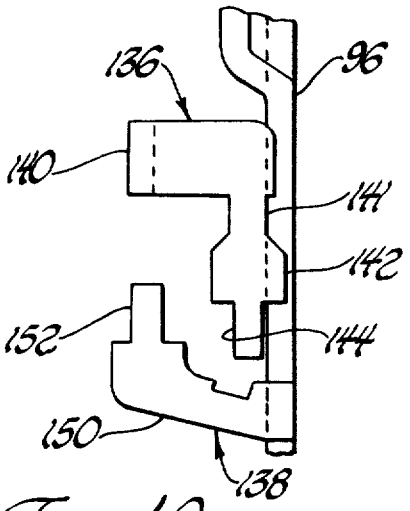
FIG. 10 is an enlarged fragmentary view taken generally on the plane of line 10—10 of FIG. 6 and looking in the direction of the arrows.
Figure 11:
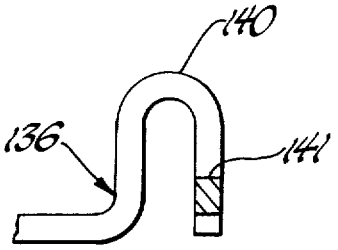
FIG. 11 is an enlarged fragmentary view taken generally on the plane of line 11—11 of FIG. 3 and looking in the direction of the arrows.
Figure 12:
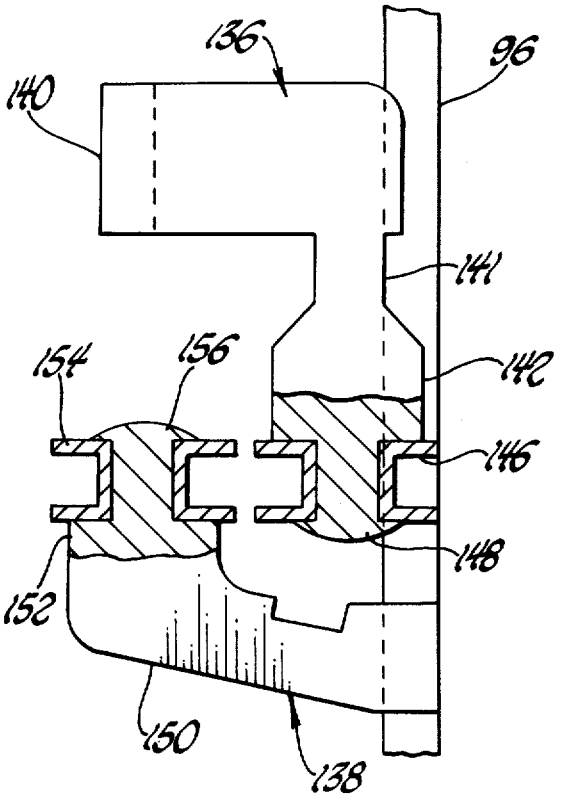
FIG. 12 is a still further enlarged fragmentary view taken generally on the plane of line 12—12 of FIG. 3 and looking in the direction of the arrows.

As illustrated in particular in FIGS. 3, 9, 10, 11 and 12, plate 96 is provided with spring holding or reaction arm means 136 and 138. As shown in FIG. 11, arm means 136 comprises a generally inverted U-shaped portion 140 with a laterally extending arm portion 141 formed integrally therewith. As shown in FIG. 10, such arm portion 141 comprises both an enlarged portion 142 and an extending reduced portion 144 which, in turn, as generally illustrated in FIG. 12, receives a spool-like member 146 retained thereon as by a peened-over portion 148 holding the spool or guide 146 against the enlarged portion 142.

As shown in FIG. 9, arm means 138 has an upwardly directed arm 150 which, as shown in FIG. 10, terminates in a generally laterally and horizontally extending arm portion 152 which, in turn, receives a second spool-like member or guide 154 retained thereon as by a peened-over portion 156 best illustrated in FIG. 12.

Figure 3:
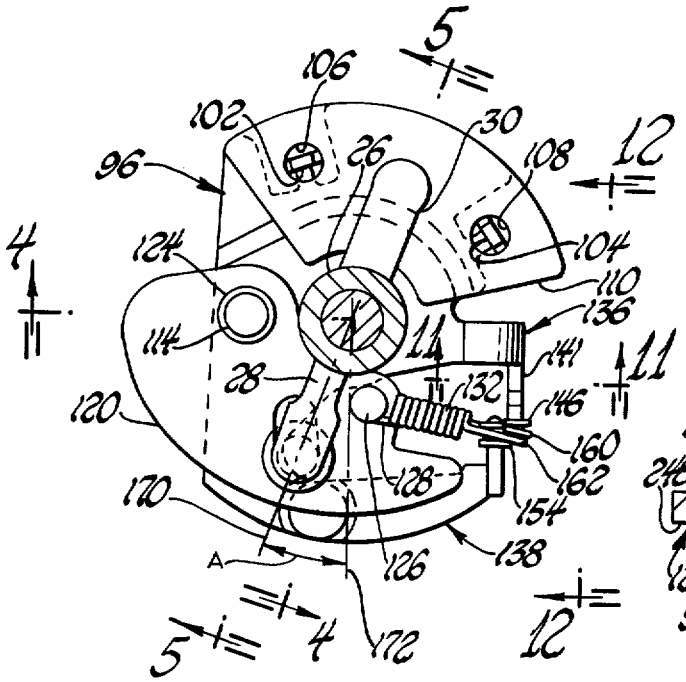
FIG. 3 is a view taken generally on the plane of line 3—3, sans distributor housing, and looking in the direction of the arrows.

As can be seen in various Figures, the spools or guides 146 and 154 serve to respectively retain looped ends 160 and 162 of primary spring 134 and secondary spring 132. With reference to FIGS. 1 and 3, it can be seen that in an initial state, as for example when the engine is shut-down, secondary spring 132 has its looped end 162 constrained by spool-guide 154 but out of abutting engagement therewith. That is, the looped end 162 extends significantly beyond the inner portion or diameter of spool 154 so that a predetermined distance or space between such spool inner diameter and the loop or bight portion of spring end 162 exists. In contrast, however, the looped end 160 of primary spring 134 is in abutting engagement with the inner diameter of spool-guide 148. The primary spring 134 serves to provide the initial resilient loading on flyweight 120 while, as will become apparent, the secondary spring 132 provides a resilient resistance only after centrifugal weight 120 as moved some predetermined degrees of rotation clockwise with respect to the axis of pivot means 114.

Figure 5:
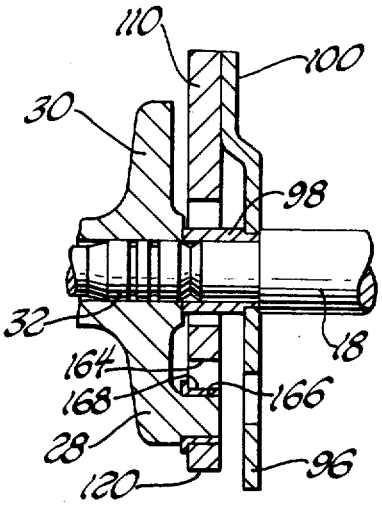
FIG. 5 is a view taken generally on the plane of line 5—5 of FIG. 3 and looking in the direction of the arrows.
Figure 6:
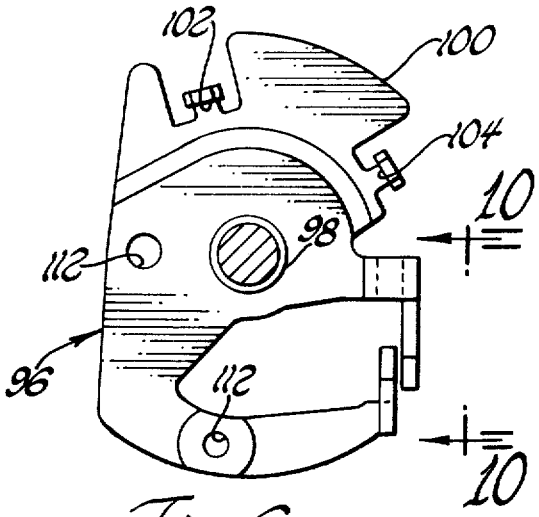
FIG. 6 is a view taken generally on the plane of line 6—6 of FIG. 1 illustrating, sans housing and other elements, one of the elements in generally top plan view.
Figure 7:
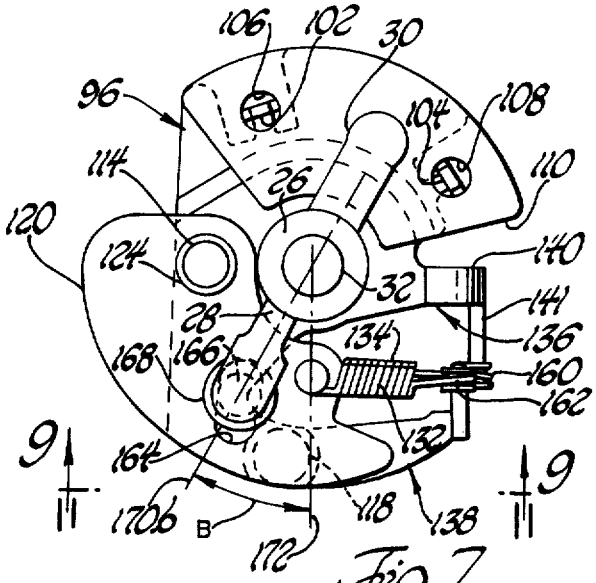
FIGS. 7 and 8 are views similar to FIG. 3 but respectively illustrating the cooperating elements in positions resulting from different engine operating conditions.
Figure 8:
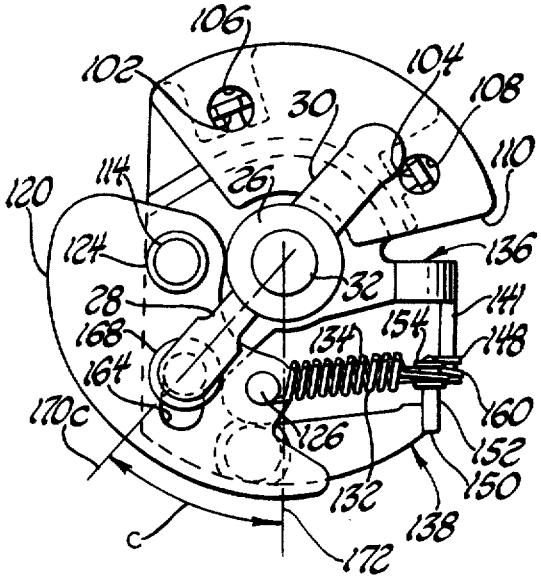

As best seen in FIG. 5 and as also shown in, for example, FIGS. 3, 7 and 8, centrifugal weight 120 has a linear or straight slot or recess 164 formed therein which receives a follower arrangement comprised of a cylindrical extension 166, formed on arm 28, and a sleeve-like bearing 168 carried thereabout.

If, for purposes of illustration, it is assumed that FIG. 3 depicts the relative positions of the various elements at curb-idle engine operation, it can be seen that the relative angular position of arm 28, as depicted by a first line of centers 170 and a vertical reference line 172, is some value A. This particular relative angular position is effectively determined by the resistance of primary spring 134. As engine speed, and therefore distributor shaft speed, increases, the centrifugal weight 120 will progressively move generally radially outwardly about its pivot 114 and, as it so does, cause the follower 166 to be rotated in the clockwise direction relative to shaft 18. In so doing both the switching or breaker rotor 24 and the distributor rotor 34, carried by shaft extension 26, are also rotated in the clockwise direction relative to shaft 18.

As shaft 18 speed of rotation continues to increase and the outward movement of centrifugal weight 120 continues against the resilient resistance of primary spring means 134, a condition will be attained, as generally depicted in FIGS. 7 and 9, wherein the primary spring means 134 has undergone significant resilient deformation or deflection whereas the secondary spring 132, physically and bodily moved by the outward movement of centrifugal weight 120, has just had its looped end 162 come into abutting engagement against the inner diameter of spool-guide retainer 154. In comparing the degrees of advance, it can be seen that the line of centers 170 of FIG. 3 has now moved to a position **170*b*** with a resulting increase in the reference angle to a value B.

As the speed of rotation of shaft 18 increases from that resulting in the elements assuming the positions depicted in FIG. 7, centrifugal weight 120 will continue to move radially outwardly but now against the combined resilient resistance of both primary spring means 134 and secondary spring means 132. As such speed of rotation continues, the follower 166, being contained within recess or slot 164, will be further continually rotated in the clockwise direction relative to shaft 18. Also, during this time, both switching or breaker rotor 24 and distributor rotor 34 are likewise further rotated clockwise relative to shaft 18. As the speed of rotation continues to increase, a condition will be attained, as generally depicted in FIG. 8, wherein both the primary and secondary spring means 134 and 132 have been extended and follower 166 has reached a maximum point of relative travel within slot 164. In comparing the degrees of ignition advance, it can be seen that the line of centers 170 of FIG. 3 (and the corresponding line **170*b* of FIG. 7) has now moved to a position 170*c*** with a resulting increase in the reference angle to a value C.

Figure 13:
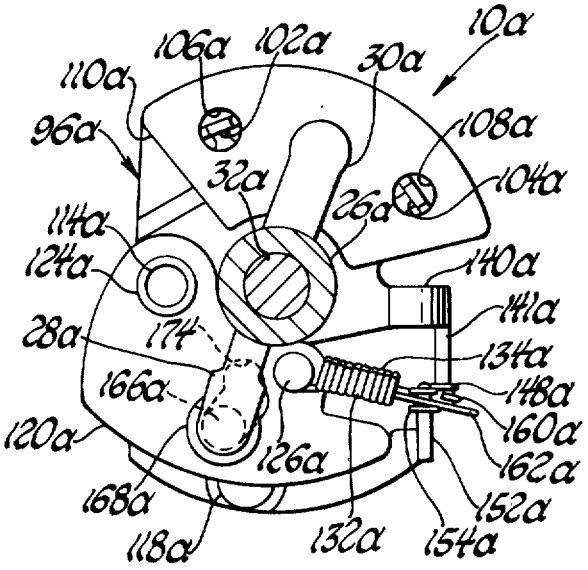
FIG. 13 is a view similar to FIG. 3 but showing a modification of the invention.

FIG. 13, a view similar to FIG. 3, illustrates a modification of the invention. In FIG. 13, elements like or similar to those of the preceding Figures are identified with like reference numbers provided with a suffix *a*.

Figure 14:
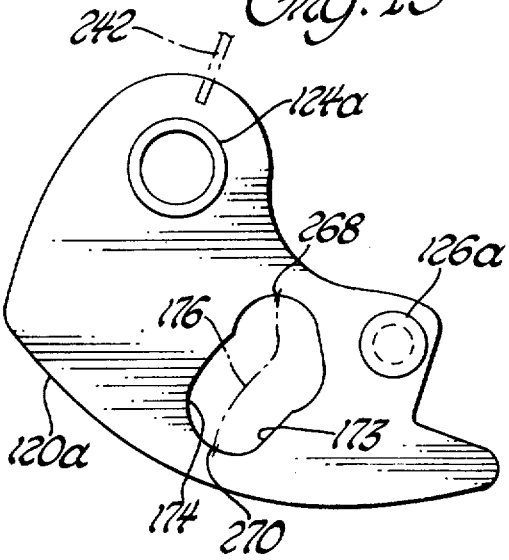
FIG. 14 is an enlarged top plan view of one of the elements shown in FIG. 13.

In the embodiment of FIG. 13, and as best shown in FIG. 14, the centrifugal weight **120*a* has a slot or recess 174 formed therein of a non-linear or predetermined contoured configuration. As illustrated in FIG. 13, the follower 166a and bearing 168*a* are collectively contained within slot 174 so that relative movement therebetween results in the locus of points, of the centerline of follower 166*a*, defining a line generally depicted at 176. Consequently, it can be seen that if the particular depicted contour of slot 174 were to be employed, there would result a lesser amount of degrees of ignition advance for an increment of increase in engine speed at the lower engine speeds while the degrees of ignition advance for an increment of increase in engine speed would significantly increase at the relatively higher engine speeds. It should be apparent that the particular selection of the configuration of slot 174 and/or slot 164 depends on the requirements of the particular engine to which the ignition distributor is to be installed. However, it should also be pointed out that even though it may, at this point, be apparent that selective shaping of the slot or cam means 164 and/or 174 is possible, the invention as herein disclosed provides means whereby operating characteristics which were heretofore impossible of attainment are now made possible. Such may better be understood and appreciated from the graphs of FIGS. 15–20 wherein each of such graphs is formed by plotting degrees of ignition advance, along the vertical axis, against speed of rotation (in R.P.M.) of the distributor shaft 18** along the horizontal axis.

Referring to FIGS. 15—20, depending on the selection of the spring rates of springs 132 and 134 and the desired configuration of slot or cam means 164 or 174, various characteristic operating curves are obtainable. That is, in FIG. 15, the portion of the curve indicated between points 200 and 202 is obtained under the resistance of primary spring 134 while the portion of the curve indicated between points 204 and 206 was obtained with the additional influence of secondary spring 132. The portion of the curve between points 202 and 204 may be obtained by the reaction of the primary spring 134 alone, or, depending on the configuration of the cam slot 164 of 174, in conjunction with the secondary spring 132. The curve segment between 202 and 204, which may be referred to as a step or dwell period, was not obtainable with prior art structures.

Figure 16:
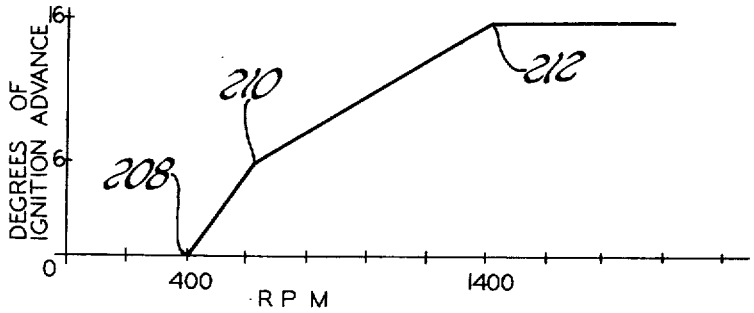

FIG. 16 illustrates a characteristic operational curve of the prior art distributors as well as one obtainable with the invention. It should be noted, however, that with such prior art structures, the secondary slope, depicted between points 210 and 212, always had to be less than the primary slope as depicted between points 208 and 210. In prior art distributors which might have had a tertiary slope, such tertiary slope was again less than the secondary slope.

Figure 17:
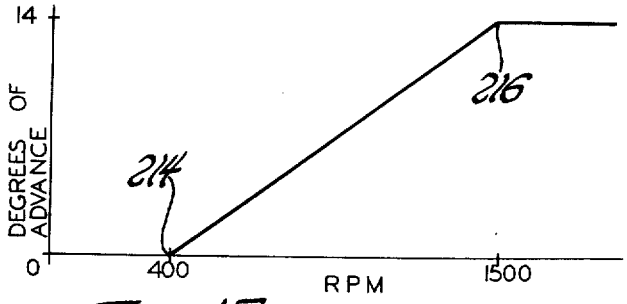

FIG. 17 also illustrates another operating curve obtained by the prior art distributors and also obtainable by the invention. Here it will be noted that the portion of the curve depicted between points 214 and 216 is a straight line curve.

Figure 18:
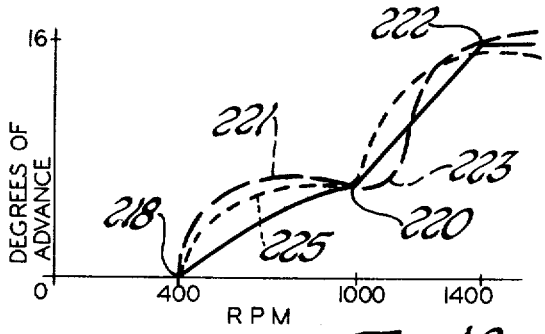

FIG. 18 graphically illustrates a number of additional beneficial operating characteristics of the invention. That is, for example, the primary curve depicted generally between points 218 and 220 may be curved as to thereby closely follow, without exceeding limits, the pre-ignition or "knock" curve of the associated engine while the secondary curve, depicted between points 220 and 222, may be a straight line of a slope greater than the slope of the primary curve.

Figure 15:
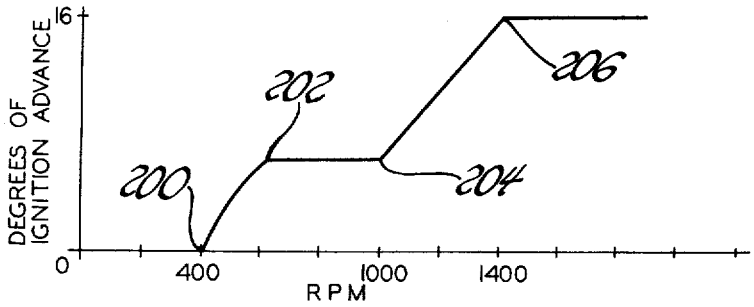
FIGS. 15–20 are respectively graphs illustrating, typically, characteristic operational curves obtainable by use of the invention.
Figure 19:
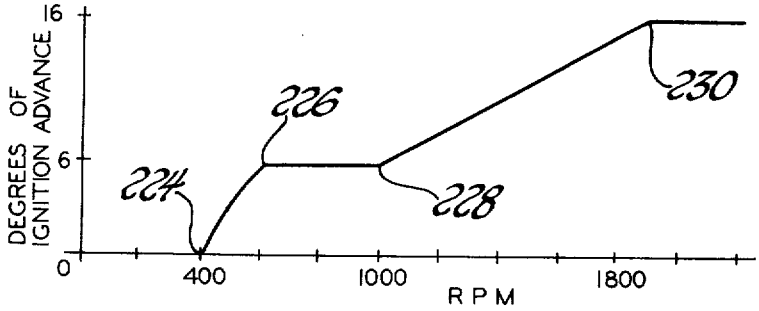

FIG. 19, illustrating a curve similar to that of FIG. 15, further depicts the secondary curve, between points 228 and 230, as being of a slope significantly less than the slope of the curved primary portion between 224 and 226 as well as significantly less than the slope of secondary curve 204, 206 of FIG. 15.

Figure 20:
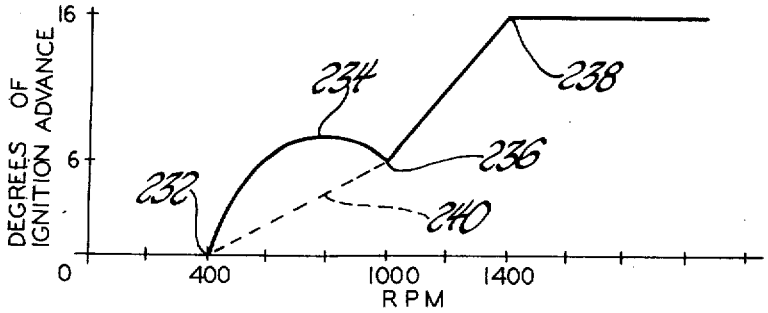

FIG. 20 illustrates another very significant and important operating characteristic obtainable by the invention. That is, the primary curve as depicted between points 232 and 236 has a region of negative slope as generally illustrated between a high point of, for example, 234 and end point 236. The secondary curve extends from point 236 to point 238.

As should be surmised from the various exemplary operational curves depicted, the invention provides an arrangement whereby any desired operating characteristic can be attained in order to assure maximum engine operating efficiency giving due consideration to the type of work such engine is to perform. This might be better appreciated with further consideration of the curve of FIG. 20.

That is, especially in the United States of America, the Federal Government, through its authorized agency, has imposed a limitation on engine exhaust emissions. The engine manufacturers, in turn, must first (in order to obtain from the Federal Government approval to sell such engines) submit their engines to prescribed and controlled testing procedures in order to determine whether such engines fall within the limits for emissions set by the Government.

Since it is a practical impossibility to establish meaningful limits for exxhaust emissions for all speeds and engine loads, the Government has, wisely, selected a particular testing point for the related engine to be tested. That is, the "test point" is selected on the basis of the predominance of engine operation. Another way of expressing that would be to say that once it is determined at what engine speed the engine, during normal use, will predominantly operate, such predominant engine speed will then be the "test point".

With reference to FIG. 20, let it be assumed that point 236 is in fact such a "test point". With the invention, and as depicted by curve portion 232, 234, 236, it becomes possible to provide the best possible relationship of degrees of ignition advance, say, for example, from point 232 to point 234 to thereby attain the best engine torque output in such lower engine speed ranges while, by providing a negative slope as between points 234 and 236, subsequently reducing the degrees of ignition advance so that the emission standards will be met when the engine speed corresponds to the "test point" 236. With prior art structures the best that could be hoped for is as generally depicted by dash-line 240 (and if not a straight line then under no circumstances a curved portion with a negative slope segment). Further, with prior art structures, if a primary curve such as 240 were attained, the secondary curve portion (236–238) would have to be of a slope less than the primary thereby again very possibly reducing the efficiency of the associated engine.

For further possible variations in calibration capability, see (FIG. 18) the relatively long dash line curve 221, with the blending junction 223 between curved primary and curved secondary portions, and relatively short dash line curve 225.

It should also be apparent that further modifications of the invention are possible. For example, instead of the cam slot or recess 164 and/or 174 being formed in the centrifugal weight 120, the slot or recess could be formed in arm 28 and the cooperating follower pin or arrangement 166 could be situated in the centrifugal weight. Further, it is not essential that a pivot such as 114 be employed. That is, it is possible that the centrifugal weight, as generally depicted in phantom line in FIG. 14, may be hingedly secured as by a very high rate spring 242 which may be flat and relatively wide having one longitudinal end secured to the centrifugal weight and the other longitudinal end secured as to the distributor shaft plate assembly 96 for rotation therewith.

Figure 4:
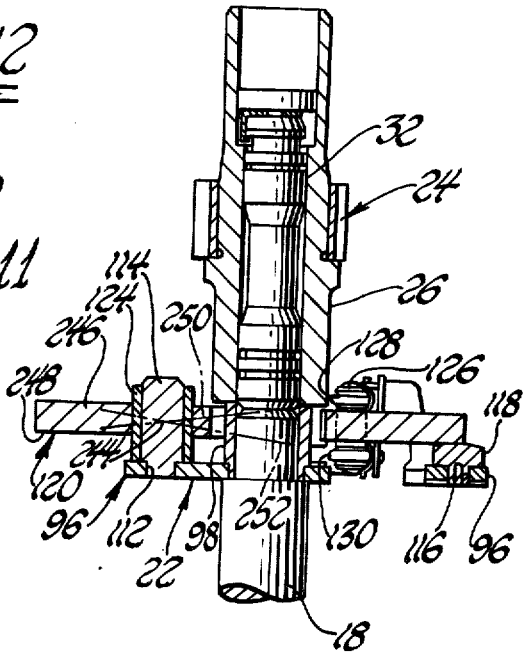
FIG. 4 is a view taken generally on the plane of line 4—4 of FIG. 3 and looking in the direction of the arrows.

Further, although not so limited, the preferred embodiment of the invention has its arm portions 152 and 144 as well as the grooves (for respectively receiving ends 128 and 130 of springs 132 and 134) in pin 126 so elevationally positioned relative to each other as to cause said springs 132 and 134 to be generally co-planar but inclined with each other thereby resulting in an effective line or lines of forces passing generally through point 244 of pivot pin 114 with such point 244 being generally midway between the upper and lower surfaces 246 and 248 of centrifugal weight 120 in a plane normal to the axis of pin 114 near the midpoint of pivot 114/124. Such lines of forces 250 and 252 as well as point 244 are depicted in FIG. 4.

Figure 21:
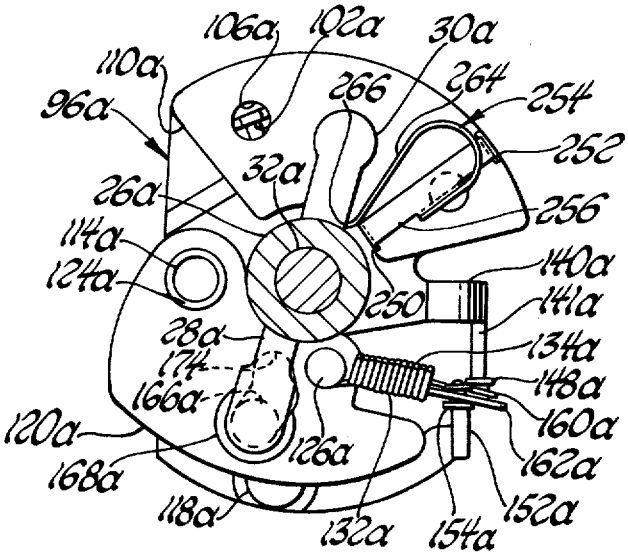
FIG. 21 is a view similar to FIG. 13 but illustrating another modification of the invention.

FIG. 21, a view similar to that of FIG. 13, illustrates a further modification of the invention. All elements in FIG. 21 which are like or similar to those of FIG. 13 are identified with like reference numbers.

Figure 22:
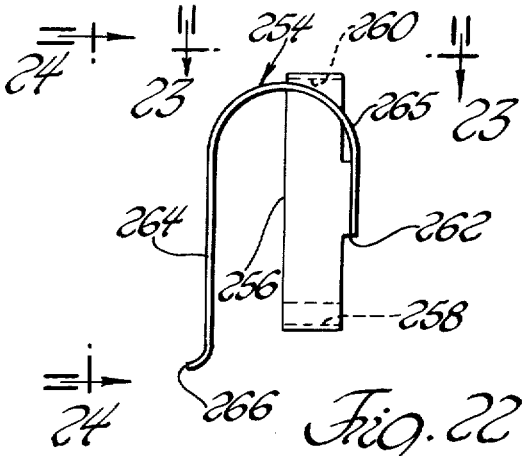
FIG. 22 is an enlarged top plan view of one of the elements shown in FIG. 21.
Figure 23:
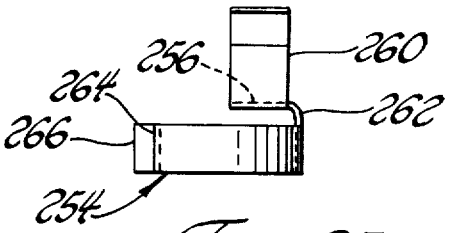
FIG. 23 is a view taken generally on the plane of line 23—23 of FIG. 22 and looking in the direction of the arrows.
Figure 24:
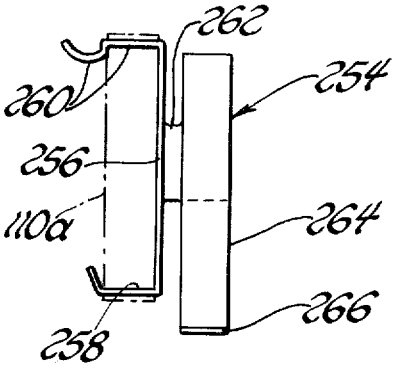
FIG. 24 is a view taken generally on the plane of line 24—24 of FIG. 22 and looking in the direction of the arrows.

Referring in greater detail to FIG. 21, a pair of opposed notches 250 and 252 are formed in the arcuate edges of counterweight **110*a* with such notches being effective to closely receive and retain leg-like clip portions of a spring 254. As also illustrated in enlarged scale in FIGS. 22, 23 and 24, the spring means 254 comprises an elongated base portion 256 having, at opposed ends thereof, downwardly depending relatively resilient clip-like securing or attaching legs 258 and 260 which, as generally depicted in FIG. 24, are respectively received in slots 250 and 252 as to be seated therein and extend generally under and against the undersurface of counterweight 110*a* to thereby maintain the spring means 254 in assembled relationship to counterweight 110a. An upwardly extending portion 262 integrally formed with base 256 serves to support a generally U-shaped spring 265 having an elongated spring arm 264 with a free end 266 thereof adapted for engagement with, for example, arm portion 30***a* as to thereby slightly but continuously exert a force thereagainst tending to rotate arm 30*a* and extension 26*a* generally counterclockwise about the axis of rotation thereof. The provision of such a biasing spring means 254 enables the easy and ready attainment of, for example, curves 221 and 225 of FIG. 18. That is, referring also to FIG. 14, by employing the biasing spring means 254, slot 174 need not be formed as to generally laterally contain the follower 166*a*; instead, the slot 174 may be comparatively wide with regard only to the desired contour 173 as between, for example, points 268 and 270 since the biasing spring means 254 will maintain such follower 166*a* in contact with the contour 173 regardless of the contour selected.

Figure 25:
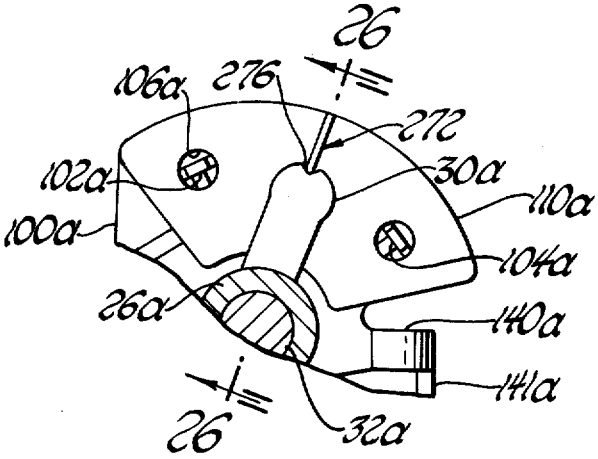
FIG. 25 is a fragmentary view, similar to FIG. 21, illustrating a further modification of the invention.
Figure 26:
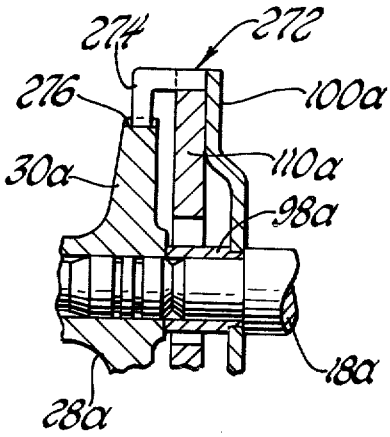
FIG. 26 is a view taken generally on the plane of line 26—26 of FIG. 25 and looking in the direction of the arrows.

Referring now in greater detail to FIGS. 25 and 26, wherein elements therein which are like or similar to those of FIG. 13 are identified with like reference numbers, leaftype spring means 272, carried as by the counterweight 110*a*, has a blade-like portion 274 received within a cooperating notch 276 formed in arm 30*a*. Spring 272 comprises a null-type spring arrangement which would exhibit a relatively slight resilient resistance to the rotation of arm 30*a* and extension 26*a*, relative to counterweight 110*a*, regardless of the direction of such relative rotation.

The provision of such null or two-directional biasing spring means 272 enables the cooperating cam slot 174 to be formed as to cause, for example, the follower 166a to ride along one side of the contour (such as a portion of contour 173) and, after weight 120*a* has moved a predetermined distance, have the same follower 166*a* actually change sides and ride against the other side of the general slot along a different contour. It should, of course, be apparent that the biasing spring means of FIGS. 21 and 25 could be employed in the same distributor assembly.

Even though the invention has been disclosed within the environment of a solid state type ignition distributor wherein no mechanical ignition switching contacts are employed, it should be made clear that the teachings of this invention are not so limited in that such teachings apply equally well to any type of ignition distributor employing, to any extent, speed responsive weights to in any way control or influence the degrees of advance of the ignition timing. Therefore, the term "switching rotor" or "switching rotor means" as herein employed is intended to read on and encompass the usual rotatable cam member in such ignition distributors which employ the cam member (operatively carried by and rotatable with the distributor shaft means) for engaging and intermittently opening associated mechanical switch contacts as well as the pulse creating rotor, as at 24, in ignition distributors which do not employ such mechanical switch contacts or any other type of ignition distributor such as, for example, those which employ light sources for triggering ignition or those which employ various means such as magnetic amplitude detection for triggering ignition.

Although only a preferred embodiment and one modification has been disclosed and described, it should be apparent that other embodiments and modifications of the invention are possible within the scope of the appended claims.

I claim:

1. An ignition distributor for an internal combustion engine, comprising drive shaft means adapted to be driven in accordance with the speed of said engine, switching rotor means operatively carried by said drive shaft means and effective to cause an opening and closing of associated electrical circuit means, said rotor means being generally coaxial with said shaft means and adapted to be angularly adjustable relative thereto and about the axis of rotation of said drive shaft means, means responsive to changes of engine operating conditions for angularly adjusting said rotor means relative to said drive shaft means, said means responsive to changes of engine operating conditions comprising a single centrifugal weight operatively carried by said drive shaft means and operatively connected to said rotor means, said centrifugal weight being effective to move radially outwardly from said axis of said shaft means in response to rotation of said shaft means and thereby cause said angular adjustment of said rotor means relative to said shaft means, at least first and second spring means located respectively above and below said single centrifugal weight and operatively connected to said single centrifugal weight for resiliently resisting said radially outward movement of said centrifugal weight bearing means having an axis for pivotally securing said single centrifugal weight and for permitting angular rotation of said single centrifugal weight about said axis, said first and second spring means being mounted with respect to each other in a manner so that the lines of resisting forces of said first and second spring means pass through a plane normal to said axis near the center of said bearing means so as to eliminate internal forces related to centifugal force between said drive shaft means and said switching means.

2. An ignition distributor according to claim 1 wherein said first and second spring means are so positioned as to have their respective lines of action generally in a plane wherein said plane is generally normal to said axis of rotation.

3. An ignition distributor according to claim 1 and further counter-weight means operatively carried by said shaft means as to be rotatable therewith, said counter-weight means being positioned as to be located generally opposite said centrifugal weight with respect to said axis of rotation.

4. An ignition distributor according to claim 1 and further comprising plate-like support means, wherein said shaft means comprises a first shaft portion and a second shaft portion, wherein said second shaft portion is carried by said first shaft portion as to be generally coaxial therewith and angularly rotatable with respect thereto, wherein said plate-like support means if fixedly carried by said first shaft portion, wherein said rotor means is fixedly carried by said second shaft portion, and said plate-like support means comprising first and second spring retaining arm portions, said arm portions being effective to respectively engage one ends of said first and second spring means.

5. An ignition distributor according to claim 4, wherein said one end of said first spring means is loosely contained by said first arm portion and only abuttingly engages said first arm portion to thereby result in said first spring means producing a resilient force only after said centrifugal weight has moved radially outwardly a predetermined distance.

6. An ignition distributor according to claim 1 wherein one of said spring means is ineffective for producing any resilient resistance against said radially outward movement of said centrifugal weight until said centrifugal weight has moved a predetermined distance radially outwardly of said axis.

7. An ignition distributor according to claim 1 wherein said centrifugal weight is operatively connected to said rotor means by interconnecting cam and follower means.

8. An ignition distributor according to claim 7, wherein said cam means is operatively carried by said centrifugal weight, and wherein said follower means is operatively connected to said rotor means.

9. An ignition distributor according to claim 4 wherein said centrifugal weight is operatively connected to said rotor means by interconnecting cam and follower means, wherein said cam means is carried by said centrifugal weight, wherein said second shaft portion comprises a generally radially extending follower arm, and wherein said follower means comprises a pin-like portion extending from said follower arm generally parallel to said axis of rotation and operatively engaging said cam means.

10. An ignition distributor according to claim 9 wherein said cam means comprises a slot-like opening formed in said centrifugal weight.

11. An ignition distributor according to claim 1 wherein said single centrifugal weight provides means for spark timing, said means for spark timing being free of any internal force between said weight and said rotor means that is a function of centrifugal force.

12. An ignition distributor according to claim 1 and further comprising third spring means, said third spring means being operatively connected to said rotor means and effective to yieldingly urge said rotor means generally angularly about said axis of rotation.

13. An ignition distributor according to claim 7, and further comprising third spring means, said third spring means being effective to yieldingly urge said rotor means generally angularly about said axis of rotation as to cause said cam and follower means to be thereby yieldingly urged against each other.

14. An ignition distributor according to claim 3, and further comprising counterweight means operatively carried by said shaft means as to be rotatable therewith, said counterweight means being positioned as to be located generally opposite said centrifugal weight with respect to said axis of rotation, wherein said centrifugal weight is operatively connected to said rotor means by interconnecting cam and follower means, and further comprising third spring means, said third spring means being effective to yieldingly urge said rotor means generally angularly about said axis of rotation as to cause said cam and follower means to be thereby yieldingly urged against each other, said third spring means comprising a base portion carried by said counterweight, and a spring arm portion carried by said base portion and operatively connected to said rotor means.

* * * * *